US005744539A

United States Patent [19]

McCoy et al.

[11] Patent Number: 5,744,539

[45] Date of Patent: Apr. 28, 1998

[54] MANUFACTURING PROCEDURES FOR MAKING HIGH POLYTETRAFLUOROETHYLENE CONTENT DISPERSIONS IN OIL FOR LUBRICANT USE AND THE COMPOSITIONS SO PRODUCED

[76] Inventors: Frederic C. McCoy, 8 Herbert Hoover Dr., New Windsor, N.Y. 12553; John P. Fay, Tower Ridge 4K, Peekskill, N.Y. 10566

[21] Appl. No.: 782,082

[22] Filed: Jan. 13, 1997

Related U.S. Application Data

[63] Continuation of Ser. No. 508,833, Jul. 28, 1995, abandoned.

[51] Int. Cl.[6] ..... C08J 51/00

[52] U.S. Cl. ..... 524/546; 524/421; 524/423; 252/16; 252/50; 252/56 R; 252/52 R; 252/51.5 R; 252/51.5 A

[58] Field of Search ..... 524/546, 421, 524/423, 16, 50; 252/56 R, 52 R, 51.5 R, 51.5 A

[56] References Cited

U.S. PATENT DOCUMENTS 4,615,817 10/1986 McCoy ..... 252/16

*Primary Examiner*—Peter D. Mulcahy

*Attorney, Agent, or Firm*—Brooks Haidt Haffner & Delahunty

[57] ABSTRACT

A polytetrafluoroethylene dispersion consisting essentially of a stable dispersion of finely divided polytetrafluoroethylene particles and a polymeric dispersing agent in a lubricating oil, the dispersions being substantially free of polytetrafluoroethylene sedimentation, together with lubricating oils containing such dispersions and processes for producing the dispersions.

28 Claims, No Drawings

MANUFACTURING PROCEDURES FOR MAKING HIGH POLYTETRAFLUOROETHYLENE CONTENT DISPERSIONS IN OIL FOR LUBRICANT USE AND THE COMPOSITIONS SO PRODUCED

This application is a continuation of application Ser. No. 08/508,833, filed Jul. 28, 1995 now abandoned.

BACKGROUND OF THE INVENTION

1. Field of the Invention

The present invention relates to the formulation and manufacture of oil concentrates of polytetrafluoroethylene having increased amounts of the polymer and enhanced storage stability than previous concentrates for use in lubricants having superior anti-friction properties, and more particularly, it relates to polytetrafluoroethylene-containing oil dispersions utilizing a polymeric dispersant containing nitrogen, together with methods for their preparation, and lubricating oils containing such dispersions.

2. Background of the Invention

The use of dispersed polytetrafluoroethylene (PTFE) particles in lubricants to reduce friction, and thereby to reduce wear, has been extensively practiced in recent years. The rationale is that the dispersed polymer will form a film on moving metal surfaces under conditions of boundary and hydrodynamic lubrication, thereby reducing frictional losses. The goals of improved fuel economy, easier starting and better drivability have been attained in automotive service by the use of PTFE dispersions. From a practical standpoint, however, dispersions containing PTFE particles must have excellent resistance to separation and sedimentation of the dispersed PTFE particles during storage for obvious reasons. U.S. Pat. No. 4,615,817, granted to applicant McCoy, described formulations and manufacturing procedures for preparing dispersions or additives containing PTFE particles that exhibited better stability than had been achieved in the prior art, pertinent references to which were cited. The additives set forth in Applicant's aforesaid patent contained a mixture of up to 10% particulate PTFE in the lubricating carrier oil along with a dispersing agent, an anti-sedimentation agent and a polar additive.

Recently, however, many manufacturers of PTFE-containing lubricants have found it economically desirable to purchase dispersion concentrates having greater percentages of PTFE components, e.g., as much as about 20% or more by weight PTFE, for subsequent dilution with the desired lubricating oil for actual service. As noted, the upper limit for PTFE content of a concentrate in Applicant's aforesaid patent was restricted to 10% or less by the fact that the commercially available PTFE powders at the time used in making the concentrates contained a substantial amount of 5–50 micron sized PTFE agglomerates, which adversely affected storage stability, requiring the addition of organoclay anti-sedimentation agents and polar additives to maintain the dispersion. This situation has been alleviated by the recent marketing of PTFE powders having a smaller and a more uniform particle size, obviating the need for additional agents to maintain the PTFE particles in dispersion.

Further, because of the expanding use of lubricant products consisting in whole or in part of synthetic carrier oils, it is especially important that PTFE concentrates be compatible with such oils and show essentially no sedimentation of the PTFE particles even after long periods of ambient storage of such synthetic-concentrate blends.

Also, as described in the above-noted McCoy patent, prior art concentrates were made using high-speed and high-shear mixing devices, such as a small blender. While this equipment is satisfactory for preparing, for example, up to about a gallon of dispersions of PTFE in oil at a time, the output capacity of these commercially available blending machines is minimal, creating a clear need for more efficient methods to manufacture large quantities of the PTFE dispersion concentrate than are currently required.

SUMMARY OF THE INVENTION

Through the use of fine and substantially uniform polytetrafluoroethylene (PTFE) particles now commercially available and selected polymeric dispersants, the present invention permits the preparation of carrier oil dispersions of PTFE containing up to about 30% by weight of PTFE particles therein which have excellent resistance to sedimentation during storage, good fluidity and outstanding compatibility with petroleum and synthetic oils. The invention further contemplates methods for the preparation of the oil dispersion concentrates as well as lubricants containing such dispersions.

The polytetrafluoroethylene dispersions of the present invention are made by admixing suitable amounts of a base oil, particulate polytetrafluoroethylene and a polymeric dispersant at moderate temperatures (30°–50° C., for example). Suitable polymeric dispersants include ethylene-propylene copolymers containing nitrogen and methacrylate copolymers, also containing nitrogen. In the present invention the use of commercially available high-volume homogenizers is preferred, in contrast to the high-speed, high-shear, low-volume blending devices used in the prior art.

The present invention is therefore an improvement over the prior art in the following significant respects:

(a) Use of very fine and substantially uniformly-sized particles of PTFE with little or no large agglomerates present to cause sedimentation, and with no need for additional agents to prevent sedimentation; and (b) Use of commercially available homogenizers in the manufacturing process, rather than smaller, high-speed, high-shear stirring devices, such as a blender, thereby greatly increasing the volumetric capacity of dispersion production.

These and other objects and advantages of the improved high-PTFE dispersions will be more fully understood when the following detailed description of preferred embodiments of the invention is read in conjunction with the illustrative examples set forth therein.

DETAILED DESCRIPTION OF PREFERRED EMBODIMENTS

The particulate polytetrafluoroethylene (PTFE) used in the present invention desirably has a molecular weight of from about 500,000 to about 2,000,000 daltons. Some of the important characteristics of powdered PTFE suitable for preparing the subject oil dispersions of the present invention are a uniform particle size averaging from about 4 to about 6 microns and an average bulk density of from about 150 to about 450 g/L. Preferred commercially available PTFE products having these characteristics include DuPont TEFLON MP-1100 and DuPont TEFLON MP-1150.

The typical characteristics of these two products, according to the manufacturers, are listed as follows, along with the preferred ranges of powdered PTFE used in practicing the present invention.

| | TEFLON MP-1100 | TEFLON MP-1150 | PREFERRED POWDERED PTFE |
|---|---|---|---|
| Average Bulk Density, g/L | 200 | 450 | 150–450 |
| Melting Point, °C. | 320 | 325 | 320 |
| Particle Size Distribution (Volume Basis) Microns | 10% <2<br>AVG.4<br>90% <8 | 10% <1.6<br>AVG.5–12<br>90% < 35 | 10% <2<br>AVG.4–6<br>90% <8 |
| Specific Surface Area $m^2/g$. | 8 | 5–10 | 8 |

Thus, for TEFLON MP-1100, about 80% of the particles have a size distribution within the range of about 2 to about 8 microns and the product average is about 4. For TEFLON MP-1150, about 80% of the particles have a size distribution within the range of about 1.6 to about 35 microns and the product average is between 5–12. In testing these and other PTFE formulations, it was found that preferably about 80% of the particles should have a size distribution within the range of about 2 to about 8 microns and the product average should be about 4–6. The substantially uniform particle size distribution PTFE so produced constitutes from more than about 10% to about 30% by weight of the dispersion, preferably about 15% to about 25%, and the average bulk density of the preferred PTFE ranges from about 150 to about 450 g/L.

The carrier oil component is a lubricating oil. It can be a mineral oil or a synthetic oil (e.g., an ester or a polyolefin). It is preferred in practicing this invention to use a refined paraffinic oil having a kinematic viscosity at 40° C. of 40–70 cs., preferably 50–60 cs., and a viscosity index of 90–95.

The preferred polymeric dispersants are ethylene-propylene co-polymers containing about 0.2% nitrogen from a reaction with, for example, N-vinyl pyrrolidone. A product of this type was available from Texaco Additive Co., and is now available from its successor in interest, Ethyl Corporation and is known as TLA-555. The aforementioned McCoy patent specified a somewhat similar dispersant, having the designation Amoco 6565. This is thought to be made by reacting an oxidized ethylene-propylene co-polymer via a Mannich base reaction involving an aldelyde and an amine. This additive, however, is no longer commercially available. Another, albeit somewhat less suitable, dispersant is a polymethacrylate copolymer containing nitrogen, made by Rohm & Haas and marketed as Acryloid 956. Both TLA-555 and Acryloid 956 consist of about 10% by weight polymer and 90% mineral oil. The TLA-555 dispersant is preferred because PTFE dispersions containing it are more compatible with synthetic base oils. It should be understood that combinations of different dispersants may be used in the dispersions of the present invention. After testing these and other dispersants, it is preferred in practicing this invention to use from about 5% to about 20%, more preferably from about 5% to about 10%, most preferably about 10%, by weight of dispersant in the PTFE dispersion.

In some instances, dispersions made by the procedures of this invention have shown streaked or grainy textures. It has been found that the desired smooth texture can frequently be achieved by adding from about 1% to about 5% of an oil concentrate of an overbased calcium sulfonate, followed by conventional stirring or agitation. The reason for this unexpected effect is unknown. A suitable overbased calcium sulfonate is marketed in the form of a 25–30% oil concentrate by, the successor in interest to Texaco Chemical Co. Ethyl Corporation under the trade name TLA-256.

Composition of Final Concentrate

As a result of the finer PTFE particulates now available, the final PTFE dispersion concentrate, which is the subject of this invention, is formulated to contain, by weight, from more than about 10% to about 30% PTFE, preferably from about 15% to about 25%, and from about 5 to about 20%, preferably from about 5% to about 10%, of one or more of the commercial dispersants, the remainder being a carrier oil such as mineral oil.

Determining Storage Stability of Dispersions

A practically significant procedure for determining the ability of dispersions of the present invention to resist sedimentation on standing consists of pouring about 200 ml. of the dispersion into a transparent plastic bottle about 7 inches tall and about 2¼ inches in diameter, and allowing the bottle to stand for up to one month at ambient temperature (25°–30° C.) with periodic visual examination to determine the presence and extent of PTFE separation therein. This is best accomplished by periodically inverting the bottle and allowing it to stand undisturbed (for about one hour). Any separated PTFE is clearly visible. This procedure is applicable, not only to concentrates containing up to 30% PTFE, but also to blends made by diluting these concentrates up to 20 times or more with various oils, petroleum-based and synthetic, in which it may subsequently be desired to employ dispersed PTFE for improved lubrication. This procedure was used in testing each of the formulations set forth in the examples, as listed in Table 1.

Manufacturing Procedures

The preparation of small quantities e.g., on the order 200–400 g, of various PTFE dispersion formulations for the purpose of screening dispersant additives or grades of PTFE powders can be conveniently done using the Waring Blender-type mixer. The appropriate amounts of oil and dispersant are weighed into the blender and stirred at the lowest speed (about 5,000 RPM) for about one minute to achieve homogeneity. Then the desired amount of powdered PTFE is added and stirring continued at the highest speed, usually about 20,000 rpm in the case of a small blender, for 5 minutes more. This completes the manufacturing procedure for producing small quantities of the desired PTFE dispersion.

For quantities of PTFE dispersions of 5–55 gallons or more, however, the above procedure would obviously be impracticable. A considerable number of commercially-sized homogenizing mixers and blenders have been examined for use in preparing the PTFE dispersions of this invention. It has been found that homogenizers, such as the SUPERHOMO Homogenizer Stellar Series 200, made by Cherry-Burrell Corp., and the Gaulin High-Pressure Homogenizer Model MC 18 with homogenizing valve, made by APV Gaulin International SA of Holland, can be effectively employed for manufacturing these dispersions. Units having capacities of 100–500 gallons per hour are also available. Other homogenizers of this type, having positive displacement pumps and homogenizing valve assemblies, are also suitable.

Although operating pressures up to 10,000 psi or more can readily be achieved, pressures of 2000–8000 psi are usually sufficient to produce the dispersions of the present invention. In some cases, more than one pass of a batch of dispersion through the homogenizer may be advantageous. For example, it has been found that 1–3 passes of the dispersion admixture through the SUPERHOMO Homogenizer at pressures from about 2,000 psi to about 8,000 psi results in a dispersion having superior characteristics (see Examples 2, 4 and 6 below).

Another commercial homogenizing device that may be used to prepare the dispersions of the present invention is a high shear mixer, such as the Silverson High Shear Batch Mixer, made by Silverson Machines, Inc. of East Longmeadow, Mass.

Either of the above machines may be employed individually, although in some instances, it may be necessary to process a given dispersion first through a high pressure homogenizer, followed by further processing in a high shear mixer, or vice versa.

Utilization of Dispersions of Invention

The PTFE dispersions of this invention are employed as concentrates to be diluted with mineral or synthetic oils for a particular lubrication application, notwithstanding that they may be used in special situations without dilution. Ratios of 1 to 20, as high as 1 to 100, or as low as 1 to 5 can be employed. The concentrates may also be used in lubricating greases in similar dilution ratios.

No restrictions on the type of machines in which the dispersions of this invention can be used is contemplated, except that their use is contraindicated wherever they may come in contact with clutch devices, such as in automatic transmissions, for example.

For many uses the PTFE dispersions of this invention may be diluted with oils containing no other additives. However, they can also be diluted with oils into which other additives have been incorporated for special applications. For example, many crankcase lubricants contain, inter alia, detergents, corrosion inhibitors, and oxidation inhibitors. The PTFE dispersions of this invention can be used with such additive-containing oils except where incompatibility, as evidenced by formation of sediment or precipitates in the blended products, is observed.

The following examples are given to illustrate embodiments of the invention as it is presently preferred to practice it. Sedimentation test results for the various examples are illustrated in Table I. Unless otherwise indicated, all ratios, percentages, parts and proportions herein are by weight.

EXAMPLE 1

One hundred forty grams of mineral oil and 20 grams of TLA-555, an ethylene-propylene copolymer modified to include nitrogen, were stirred in a blender at the lowest speed (about 5,000 RPM) until the two components thoroughly mixed (about one minute). To this blend was added 40 grams of powdered PTFE (TEFLON MP-1100) and stirring then continued at the highest speed (about 15,000–20,000 RPM) for five minutes.

As listed in Table 1 below, no PTFE sediment was found in the dispersion after standing for one day at room temperature and there was only trace sedimentation after one month. In the 1:20 blend with mineral oil, no sediment was seen after standing for 1 month. In the 1:20 blend with synthetic oil A, a fully formulated motor oil known as Castrol Syntec Motor Oil FSX containing a diester, there was only trace sedimentation after standing for one month.

EXAMPLE 2

567 lbs. of mineral oil and 81 lbs. of an ethylene-propylene copolymer containing nitrogen (TLA-555) were charged to a 200 gallon tank, which was equipped with a propeller and an air spider, and mixed thoroughly. Then enough TEFLON MP-1100 was added, e.g., approximately 162 lbs., to provide a concentration of about 20% of PTFE by weight in the final dispersion, and stirring was continued until the mixture appeared uniform. Then air agitation was begun and the stirred mixture was pumped into a 5 gallon hopper tank of a SUPERHOMO Homogenizer, which was started at 2000 psi and the hopper tank was kept about ⅔ full by steady addition from the blending tank. The output product from the homogenizer was run into a 55 gallon drum, which was filled in about 20 minutes. Another 55 gallon drum was filled from the blend remaining in the large tank. Since the product after the first pass through the homogenizer showed some sediment, the product from the two drums was pumped back into the blending tank and the entire 100 gallons passed through the homogenizer two more times. The final dispersion product showed no sediment after standing at room temperature for one month, as shown in Table 1.

As also shown in Table 1, the 1:20 blends with mineral oil or synthetic oil A showed no PTFE sediment after standing one month at room temperature.

EXAMPLE 3

One hundred forty grams of mineral oil and 20 grams of a methacrylate copolymer (Acryloid 956) were stirred in a blender at the lowest speed (about 5,000 RPM) for one minute. To this blend was added 40 grams of TEFLON MP-1100 and stirring continued at the highest speed (about 15,000–20,000 RPM) for five minutes.

As listed in Table 1, after standing for one day at room temperature, there is no PTFE sediment in the dispersion. In the 1:20 blend with mineral oil, there was a trace of PTFE sedimentation after 1 month, and there was complete separation after 2 days in the 1:20 blend with synthetic oil A. Separation of the PTFE in the 1:20 blend with Synthetic Oil A is apparently due to some incompatibility between this oil and Acryloid 956. No such incompatibility was observed, however, with the TLA-555 dispersant used in Example 2.

EXAMPLE 4

24.5 lbs. of mineral oil and 3.5 lbs. of Acryloid 956 were stirred in a 5 gallon container with an electrical stirrer until the blend appeared to be homogeneous. Then 7.0 lbs. of TEFLON MP-1100 was added and stirring continued until the mixture appeared uniform. The mixture was then transferred to a 7–8 gallon hopper attached to the Superhomo Homogenizer. The mixture was run through the homogenizer at 2000 psi three times.

As shown in Table 1, there was no PTFE sediment in the dispersion after standing for one day at room temperature, and no PTFE sediment was found in the 1:20 blend with mineral oil after one month. In the 1:20 blend with synthetic oil A, there was no sedimentation after standing for 2 days but heavy sedimentation at 1 month. Regarding the 1:20 blend with synthetic oil B, there was heavy sedimentation after standing 17 days.

EXAMPLE 5

One hundred forty grams of mineral oil and 20 grams of TLA-555 were blended for approximately 1 minute at low speed, e.g., at about 5,000 RPM. Forty grams of TEFLON MP-1150 were then added and blended therewith at the highest speed (about 15,000–20,000 RPM) for 5 minutes.

As set forth in Table 1, there was light PTFE sedimentation in the dispersion after standing for one month at room temperature. After 9 days, there was light sedimentation in the 1:20 blend with mineral oil and medium PTFE sedimentation after 1 day in the 1:20 blend with synthetic oil B. On comparing Examples 1 and 5, it is obvious that MP-1150 is more difficult to disperse than MP-1100.

EXAMPLE 6

The same procedure was followed as for Example 4, except that TEFLON MP-1150 was used in place of MP-1100.

As listed in Table 1, there was light PTFE sedimentation in the dispersion after standing 2 weeks at room temperature, and light sedimentation in the 1:20 blend with mineral oil after 9 days. There was only trace sediment in the 1:20 blend with synthetic oil A after 2 days, and trace sediment in the 1:20 blend with synthetic oil B after 1 day.

EXAMPLE 7

117 grams of SEN-150 mineral oil and 15 grams of TLA-555 were stirred in a Waring Blender until homogeneous. Then 60 grams of TEFLON MP-1100 PTFE was added and stirring continued, resulting in a soft gel. While stirring the mixture at a low speed, 10 grams of TLA-256, an overbased calcium sulfonate, were added and stirring continued. The blend immediately became fluid and after stirring for an additional 4 minutes at the highest speed, the blend became very fluid.

EXAMPLE 8

160 grams of SEN-325 mineral oil and 20 grams of TLA-555 were stirred in a blender until homogeneous. Then 20 grams of TEFLON MP-1100 PTFE was added and stirring continued at the lowest speed setting until the mixture became homogeneous. Stirring was then continued at the highest speed for 5 minutes. The resulting dispersion, containing approximately 30% PTFE, was fluid and showed only a trace of sediment after one month. Blends of the dispersion in mineral oil (5%) showed only a trace of sedimentation after one month and blends in synthetic oil showed only a trace of sediment in a synthetic motor oil after 17 days.

EXAMPLE 9

700 grams of mineral oil, 100 grams of TLA-555 and 20 grams of TEFLON MP-1150 PTFE were stirred with moderate paddle stirring until a uniform slurry was obtained. This slurry was then processed for 5 minutes with a Silverson High Shear Mixer, using the smallest screen available, i.e., 1/32 inch holes. The resulting dispersion had a smooth, uniform appearance. After 24 hours, however, the container had a small amount of dense sediment present. Therefore, it was not examined for compatibility with mineral and synthetic oils.

EXAMPLE 10

324 grams of mineral oil, 46 grams of TLA-555 and 96 grams of TEFLON MP-1100 PTFE were hand-stirred until a uniform appearance resulted. Then this blend was processed in the Silversen High Shear Mixer for 3 minutes, using the finest screen available (1/32 inch). After 24 hours, the product had a trace of sediment.

EXAMPLE 11

400 grams of a dispersion consisting of 70% mineral oil, 10% TLA-555 and 20% MP-1150 PTFE made on a SUPERHOMO-type homogenizer was processed in the Silversen High Shear Mixer for 5 minutes. There was no sediment in the product after 2 weeks, and no sediment in mineral and synthetic oils after more than 17 days.

TABLE 1

| | EXAMPLE NO. | | | | | | |
|---|---|---|---|---|---|---|---|
| | 1 | 2 | 3 | 4 | 5 | 6 | 7 |
| TYPE MIXER | Waring Blender | SUPERHOMO Homogenzier | Waring Blender | SUPERHOMO Homog. | Waring Blender | SUPERHOMO Homog. | Waring Blender |
| COMPOSITION (WT. %) | | | | | | | |
| MINERAL OIL | 70 | 70 | 70 | 70 | 70 | 70 | 57.9 |
| ETHYLENE-PROPYLENE CO-POLYMER (TLA-555)(1) | 10 | 10 | — | — | 10 | 10 | 7.4 |
| METHACRYLATE COPOLYMER (ACRYLOID 956) | — | — | 10 | 10 | — | — | — |
| PTFE | | | | | | | |
| DUPONT MP-1100 | 20 | 20 | 20 | 20 | — | — | 29.7 |
| DUPONT MP-1150 | — | — | — | — | 20 | 20 | — |
| CA. SULFONATE (Overbased) (TLA-256)(2) | — | — | — | — | — | — | 4.9 |
| APPEARANCE OF 20% DISPERSION | | | | | | | |
| After 1 Day | No Sediment | N/A | No Sed. | No Sed. | Light Sed. | Lt. Sed. | No Sed. |
| After 2 Weeks | N/A | No Sed. | N/A | N/A | N/A | Lt. Sed. | No Sed. |
| After 1 Month | Trace Sed. | No SEd. | N/A | N/A | Lt. Sed. | N/A | No Sed. |
| APPEARANCE OF 5% BLEND IN MINERAL OIL | | | | | | | |
| After 4 Days | N/A | N/A | N/A | N/A | Lt. Sed. | N/A | No Sed. |
| After 9 Days | N/A | N/A | N/A | N/A | Lt. Sed. | Lt. Sed. | N/A |

TABLE 1-continued

| | | | | | | | |
|---|---|---|---|---|---|---|---|
| After 2 Weeks | No Sed. | N/A | N/A | N/A | N/A | N/A | Tr. Sed. |
| After 1 Month | No Sed. | No Sed. | Tr. Sed | No Sed. | N/A | N/A | Tr. Sed. |
| APPEARANCE OF 5% BLEND IN SYNTHETIC OIL A(3) | | | | | | | |
| After 2 Days | No Sed. | N/A | Complete Separation | No Sed. | N/A | Tr. Sed. | Tr. Sed. |
| After 1 Month | Tr. Sed. | No Sed. | N/A | Heavy Sed. | N/A | N/A | N/A |
| APPEARANCE OF 5% BLEND IN SYNTHETIC OIL B(4) | | | | | | | |
| 1 Day | N/A | No Sed. | N/A | N/A | Med. Sed. | Tr. Sed. | No Sed. |
| 17 Days | N/A | No Sed. | N/A | Hvy. Sed. | N/A | N/A | Tr. Sed. |

| | EXAMPLE NO. | | | |
|---|---|---|---|---|
| | 8 | 9 | 10 | 11 |
| TYPE MIXER | Waring Blender | Silverson High Shear Mixer (5 min.) | Silverson High Shear Mixer (3 min.) | SUPERHOMO Homog. Silveron High Shear Mixer (3 Min.) |
| COMPOSITION (WT. %) | | | | |
| MINERAL OIL | 80 | 70 | 70 | 70 |
| ETHYLENE-PROPYLENE CO-POLYMER (TLA-555)(1) | 10 | 10 | 10 | 10 |
| METHACRYLATE COPOLYMER (ACRYLOID 956) | — | — | — | — |
| PTFE | | | | |
| DUPONT MP-1100 | 10 | — | 20 | — |
| DUPONT MP-1150 | — | 20 | — | 20 |
| CA. SULFONATE (Overbased) (TLA-256)(2) | — | — | — | — |
| APPEARANCE OF 20% DISPERSION | | | | |
| After 1 Day | No Sed. | Lt. Sed. | Tr. Sed. | No Sed. |
| After 2 Weeks | No Sed. | N/A | Tr. Sed. | No Sed. |
| After 1 Month | Tr. Sed. | N/A | N/A | N/A |
| APPEARANCE OF 5% BLEND IN MINERAL OIL | | | | |
| After 4 Days | No Sed. | N/A | No Sed. | No Sed. |
| After 9 Days | No Sed. | N/A | N/A | No Sed. |
| After 2 Weeks | No Sed. | N/A | N/A | No Sed. |
| After 1 Month | Tr. Sed. | N/A | N/A | N/A |
| APPEARANCE OF 5% BLEND IN SYNTHETIC OIL A(3) | | | | |
| After 2 Days | N/A | N/A | No Sed. | No Sed. |
| After 1 Month | N/A | N/A | N/A | No Sed. |
| APPEARANCE OF 5% BLEND IN SYNTHETIC OIL B(4) | | | | |
| 1 Day | No Sed. | N/A | No Sed. | No Sed. |
| 17 Days | Tr. Sed. | N/A | N/A | No Sed. |

(1)TLA-555 is a modified ethylene-propylene copolymer containing about 0.2% nitrogen from a reaction with N-vinyl pyrrolidone.
(2)TLA-256 is an oil concentrate of an overbased calcium Sufonate (approx. 25 total Base Number) containing 2.7% calcium.
(3)Synthetic Oil A is Castrol Syntec Motor Oil FSX (containing a diester).
(4)Synthetic Oil B is Spectro Full Synthetic Race Oil (containing a diester).
N/A - results not available.

Analysis of the data of Table I shows the following:

1. The PTFE dispersion made with the homogenizer (Example 2) is slightly better after one month as regards sedimentation of the PTFE particles than the same formulation made with the blender (Example 1).

2. PTFE dispersions containing TLA-555 as the dispersant (Examples 1 and 2) are much better as regards compatibility with ester-based lubricants than those made with Acryloid 956 (Examples 3 and 4). Compatibility with mineral oil was satisfactory with both dispersants.

3. A PTFE dispersion made with DuPont MP-1150 PTFE and TLA-555 using the homogenizer (Example 6) is better as regards compatibility with ester-based lubricants, such as Synthetic Oil B, than the PTFE dispersions of Example 5 made with the blender. Compatibility with mineral oil was the same for both methods of manufacture.

4. Also, as shown in Example 7, dispersions having as much as about 30% of PTFE particles with essentially no sedimentation may be prepared. Further, as a result of the finer PTFE particulates currently available, dispersions having more than about 10% PTFE particles, as shown in Example 8, which have essentially no sedimentation, may also be prepared.

5. Processing of a dispersion of MP-1150 PTFE with a SUPERHOMO-type homogenizer followed by further processing in the Silverstein High Shear Mixer (Example 11) gave a product with better resistance to sedimentation than that produced by either apparatus separately (Examples 6 and 9).

Thus, it is evident that, since the capacity of homogenizers is much higher than for the blender, and since the quality of the dispersion is better, homogenizers offer a superior method for manufacturing the dispersions of the present invention.

Even though PTFE concentrations from more than about 10% to about 30% are acceptable in practicing the present invention, it is believed that dispersions having a PTFE concentration of from about 15% to about 25% are particularly useful and are preferred.

Although preferred embodiments of the invention have been described and illustrative examples set forth, it will be apparent to those skilled in the art that various modifications can be made without departing from the spirit of the invention.

What is claimed is:

1. A fluid polytetrafluoroethylene dispersion having excellent resistance to sedimentation, said polytetrafluoroethylene dispersion, in parts by weight of the dispersion, consisting essentially of:

(a) 15% to about 30% particulate polytetrafluoroethylene having a substantially uniform particle size distribution where at least about 80% of the particles have a size in the range from about 1.6 microns to about 35 microns and on a volume basis, the average is about 4–12 microns;

(b) about 5% to about 20% of an ethylene-propylene copolymer containing about 0.2% of nitrogen as a dispersing agent to disperse said polytetrafluoroethylene; and (c) the balance substantially a lubricating carrier oil.

2. The polytetrafluoroethylene dispersion of claim 1, wherein said polytetrafluoroethylene particles comprise 15–25% by weight, of the dispersion.

3. The PTFE dispersion of claim 1 wherein said particle size distribution has 80% of said polytetrafluoroethylene particles in the range from about 2 microns to about 8 microns.

4. The polytetrafluoroethylene dispersion of claim 1, wherein said particulate polytetrafluoroethylene is a mixture of polytetrafluoroethylene particles, the PTFE having a molecular weight in the range of aboaut 500,000 to 2,000,000 daltons.

5. The polytetrafluoroethylene dispersion of claim 1, wherein said dispersing agent comprises about 5 to 10% by weight, of the dispersion.

6. The polytetrafluoroethylene dispersion of claim 1, wherein said carrier oil is a mineral oil.

7. The polytetrafluoroethylene dispersion of claim 1, wherein said carrier oil is selected from the group consisting of a lubricating oil containing an ester, a lubricating oil containing a diester and mixtures thereof with mineral oil and a polyolefin and mixtures thereof with mineral oil.

8. The polytetrafluoroethylene dispersion of claim 1, wherein said carrier oil is a paraffinic oil having a kinematic viscosity, at 40° C., of about 40–70 centipoise and a viscosity index of about 90–95.

9. The polytetrafluoroethylene dispersion of claim 1 further comprising from about 1% to about 5% by weight of an overbased calcium sulfonate.

10. A lubricant composition comprising the polytetrafluoroethylene dispersion of claim 1 in an amount effective to reduce friction, and a lubricating substance selected from the group consisting of lubricating oils and greases, the weight ratio of said polytetrafluoroethylene dispersion to said lubricating substance ranging from about 1:1 to 1:100.

11. The lubricant composition of claim 10 further comprising a detergent.

12. The lubricant composition of claim 10 further comprising a corrosion inhibitor.

13. The lubricant composition of claim 10 further comprising an oxidation inhibitor.

14. The lubricant composition of claim 10 wherein said dispersion further comprises from about 1% to about 5% by weight of an overbased calcium sulfonate.

15. A fluid polytetrafluoroethylene dispersion having excellent resistance to sedimentation, said polytetrafluoroethylene dispersion, in parts by weight of the dispersion, consisting essentially of:

(a) 20% to about 30% particulate polytetrafluoroethylene having a substantially uniform particle size distribution where about 80% of the particles are in the range from about 2 microns to about 8 microns;

(b) about 5% to about 15% of a polymeric dispersing agent effective to disperse said polytetrafluoroethylene and comprising an ethylene-propylene copolymer reacted with N-Vinyl-pyrrolidone; and (c) the balance essentially a lubricating carrier oil.

16. A lubricant composition comprising the polytetrafluoroethylene dispersion as set forth in claim 15 in an amount effective to reduce friction, and a lubricating substance selected from the group consisting of lubricating oils and greases, the weight ratio of said polytetrafluoroethylene dispersion to said lubricating substance ranging from about 1:1 to 1:100.

17. A method of preparing a fluid polytetrafluoroethylene dispersion having excellent resistance to sedimentation, consisting essentially of the steps of:

(a) preparing a mixture of a carrier oil and about 5 to 20% by weight of the dispersion of an ethylene-propylene copolymer containing about 0.2% of nitrogen as a dispersing agent;

(b) adding to the mixture 15% to 30% by weight of the dispersion of particulate polytetrafluoroethylene, said polytetrafluoroethylene having a substantially uniform particle size distribution where about 80% of the particles are in the range from about 1.6 microns to about 35 microns and which on a volume basis, the average is about 4–12 microns; and (c) admixing the carrier oil, dispersing agent and particulate polytetrafluoroethylene obtained in step (b) to form said dispersion.

18. The method of claim 17 wherein said admixing is done in a homogenizer.

19. The method of claim 18 wherein the admixture is passed through said homogenizer at least two times.

20. The method of claim 18 wherein said homogenizer is a high pressure homogenizer.

21. The method of claim 20 wherein the admixture is passed through said homogenizer from 1 to 3 times at a pressure of from about 2,000 to about 8,000 psi.

22. The method of claim 17 wherein said admixing is done in a high shear mixer.

23. The method of claim 22 wherein the admixture is passed through said high shear mixer at least two times.

24. The method of claim 22 wherein after passing the admixture through said high shear mixer the admixture is then passed through a homogenizer.

25. The method of claim 18 wherein after the admixture is admixed in said homogenizer the admixture is then passed through a high shear mixer.

26. A fluid polytetrafluoroethylene dispersion having excellent resistance to sedimentation, said polytetrafluoroethylene dispersion, in parts by weight of the dispersion, consisting of:

(a) 15% to about 30% particulate polytetrafluoroethylene having a substantially uniform particle size distribution where at least about 80% of the particles have a size in the range from about 1.6 microns to about 35 microns and on a volume basis, the average is about 4–12 microns;

(b) about 5% to about 20% of an ethylene-propylene copolymer containing about 0.2% of nitrogen as a dispersing agent to disperse said polytetrafluoroethylene to provide for dispersion of said polytetrafluoroethylene; and (c) the balance substantially a lubricating carrier oil.

27. A fluid polytetrafluoroethylene dispersion having excellent resistance to sedimentation, said polytetrafluoroethylene dispersion, in parts by weight of dispersion, consisting of:

(a) 22% to about 30% particulate polytetrafluoroethylene having a substantially uniform particle size distribution where about 80% of the particles are in the range from about 2 microns to about 8 microns;

(b) about 5% to about 15% of a polymeric dispersing agent effective to disperse said polytetrafluoroethylene and comprising an ethylene-propylene copolymer reacted with N-Vinyl-pyrrolidone; and (c) the balance essentially a lubricating carrier oil.

28. A method of preparing a fluid polytetrafluoroethylene dispersion having excellent resistance to sedimentation and consisting of about 5% to 20% by weight of an ethylene-propylene copolymer containing about 0.2% of nitrogen as a dispersing agent and 15% to 30% by weight of the dispersion of particulate polytetrafluoroethylene, wherein said polytetrafluoroethylene has a substantially uniform particle size distribution where about 80% of the particles are in the range from about 1.6 microns to about 35 microns and which on a volume basis, the average is about 4–12 microns; said method comprising the steps of:

(a) preparing a mixture of a carrier oil and about 5 to 20% by weight of the dispersion of an ethylene-propylene copolymer containing about 0.2% of nitrogen as a dispersing agent;

(b) adding to the mixture substantially 15% to 30% by weight of the dispersion of said particulate polytetrafloroethylene; and (c) admixing the carrier oil, dispersing agent and particulate polytetrafluoroethylene of step (b) to form said dispersion.

* * * * *